United States Patent [19]

Wyner

[11] 4,204,495

[45] May 27, 1980

[54] APPARATUS FOR APPLYING A LIQUID TO A SURFACE

[75] Inventor: Jay S. Wyner, Sands Point, N.Y.

[73] Assignee: Therma-Plex, Long Island City, N.Y.

[21] Appl. No.: 954,357

[22] Filed: Oct. 25, 1978

[51] Int. Cl.[2] ..... B05C 5/00

[52] U.S. Cl. ..... 118/300; 134/102; 134/183; 239/383

[58] Field of Search ..... 118/300, 305; 239/383, 239/351, 369; 134/94, 102, 183; 15/404

[56] References Cited

U.S. PATENT DOCUMENTS

| | | | |
|---|---|---|---|
| 1,974,538 | 9/1934 | Johnston | 239/383 |
| 1,998,100 | 4/1935 | Shepherd et al. | 427/315 |
| 2,783,090 | 2/1957 | Minerley | 239/383 X |
| 2,855,330 | 10/1958 | Griswold et al. | 427/244 |
| 3,910,266 | 10/1975 | Kawase | 128/66 |

*Primary Examiner*—John P. McIntosh

[57] ABSTRACT

Apparatus for applying a liquid from a tank to a nozzle which is adapted to be held against a surface of a porous material for deep penetration of the surface by the liquid. An air stream is provided by a blower and aspirates the liquid from the tank. A fan is positioned in the path of the air stream which flows through an apertured plate. The rotation of the fan caused by the flowing air stream results in the blades of the fan covering and uncovering, in succession, the apertures of the plate, thereby resulting in a pulsating delivery of the liquid-air mixture to the surface of the porous material for deep penetration thereof by the liquid.

9 Claims, 4 Drawing Figures

APPARATUS FOR APPLYING A LIQUID TO A SURFACE

BACKGROUND OF THE INVENTION

Porous surfaces of brick and stone building deteriorate over time because of many reasons, but a major cause of such deterioration are various deteriorating ingredients found in the air. There are many coating materials available for protecting these surfaces but, unfortunately, they wear out in time due to adverse weather conditions and other reasons. Usually, these coating materials have been applied by a brush or have been sprayed on under slight pressure. Shallow penetration of the surfaces of the porous materials by the protective coating material has thus resulted.

The apparatus of the present invention provides relatively deep penetration of the surface of the porous material by the protective liquid and accomplishes this with relatively simple and inexpensive equipment.

Moreover, when the protective liquid has superior heat insulating qualities, heat loss through the treated surface is substantially reduced. A suitable liquid containing a polyacrylic ester is PLEXI-SEAL, a trademark of Plexi-Seal Protective Corp., Long Island City, N.Y.

SUMMARY OF THE INVENTION

Apparatus for applying a liquid to a surface, comprising a tank for supplying said liquid, an air blower for supplying a stream of air, a nozzle adaptable for being placed against said surface, hose means interconnecting said nozzle to said blower and said tank for aspirating said liquid from said tank during the operation of said blower, a rotary fan mounted on said blower and an apertured plate positioned adjacent said fan, said fan and plate being positioned in the path of said air stream, whereby a pulsating liquid-air mixture is applied to said surface for impregnation thereof by said liquid during the operation of said blower.

DETAILED DESCRIPTION

Figure 1:
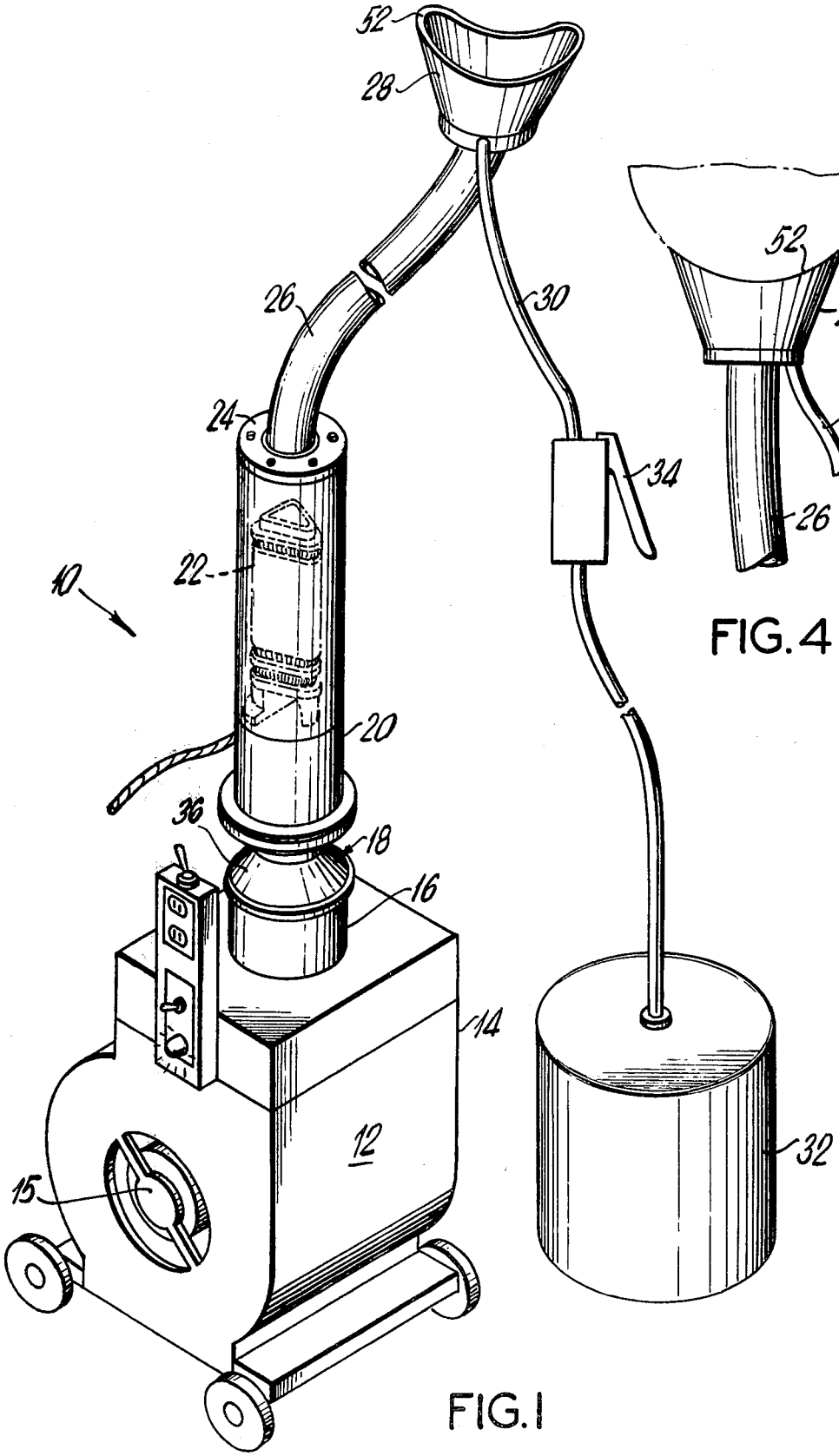
FIG. 1 is a perspective view of the apparatus of the present invention.

The apparatus 10 of FIG. 1 comprises an air blower 12 of the motor and fan assembly 15 of the blower, having a housing 14 from which extends downstream a hollow tube 16 on which is mounted at its upper end a rotary fan assembly 18. Extending from the upper end of fan assembly 18, downstream thereof, is another hollow tube 20 in which is suitably mounted an electric air heater 22. A circular plate 24 is bolted to the upper end of tube 20, and a flexible hose 26 extends therefrom and is connected to a nozzle 28. Also connected to nozzle 28 is a flexible tube 30 which is connected to a nozzle 28. Also connected to nozzle 28 is a flexible tube 30 which is connected to the top of a liquid supply tank 32 containing a suitable preservative liquid for coating the surface of a porous material, such as brick and stone. A hand-operated shut-off valve 34 is provided in tube 30 for controlling the flow of liquid through the hose. It should be understood that both hose 26 and tube 30 terminate in the base of nozzle 28 to provide inlets to the nozzle for the air from hose 26 and the liquid from tube 30.

Figure 2:
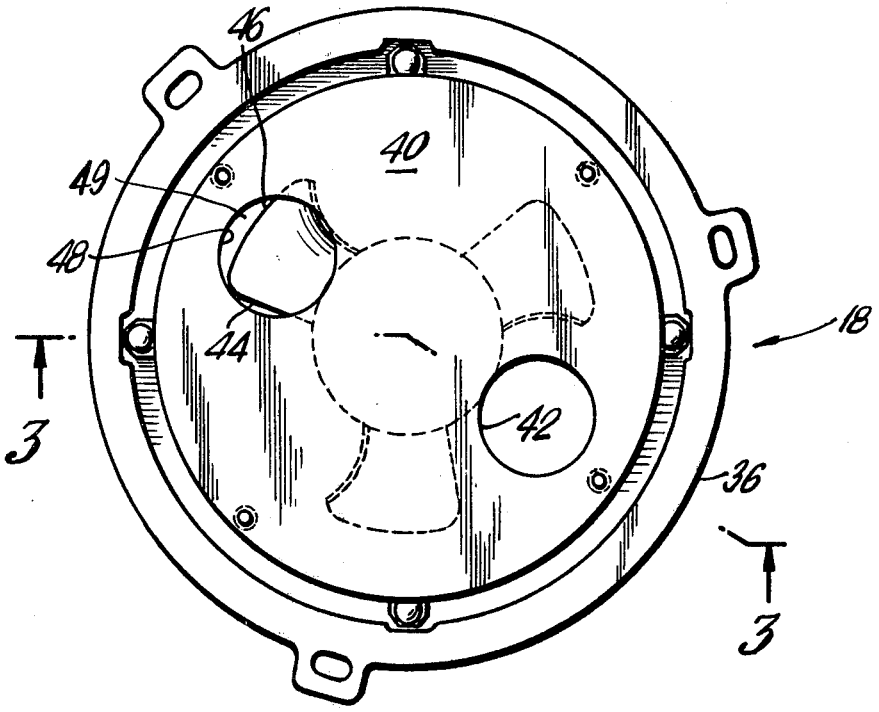
FIG. 2 is a plan view showing the fan and apertured plate of the apparatus.
Figure 3:
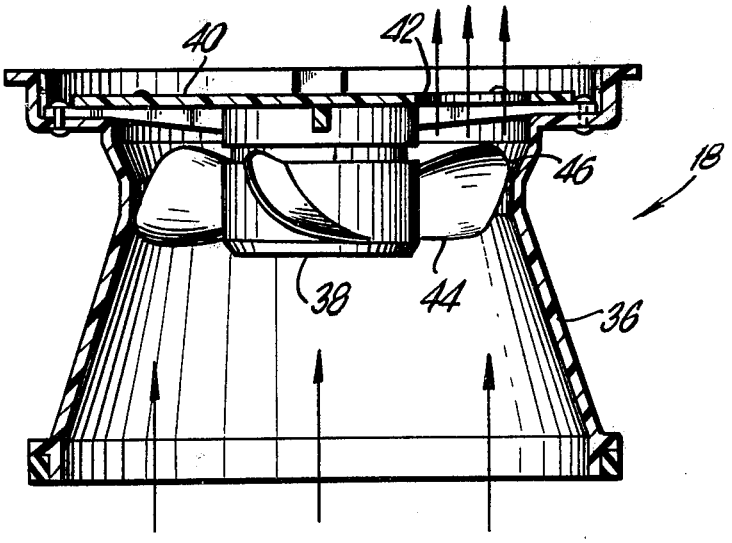
FIG. 3 is a sectional view taken on line 3—3 of FIG. 2.

Referring now to FIGS. 2 and 3, rotary fan assembly 18 comprises a conically-shaped housing 36 in which is suitably mounted a fan 38. The upper end of housing 36 is covered by a circular plate 40 having a pair of diametrically opposed circular apertures 42. It is to be noted that the radially extending blades 44 of fan 38 are positioned adjacent plate 40, upstream thereof, in overlying relation to apertures 42, and that the ends 46 of the fan blades terminate radially inwardly of the outer edges 48 of apertures 42. It will be noted further that rotation of blades 44 results in successive covering and uncovering of apertures 42 resulting in a pulsating air flow through plate 40 and in hose 26. However, there is always a flow of some air through plate 40 during the operation of the fan because of the spaces 49 defined by edges 48 of the apertures and ends 46 of the fan blades. This results in a continuous, but pulsating flow, of air during operation of blower 12.

Figure 4:
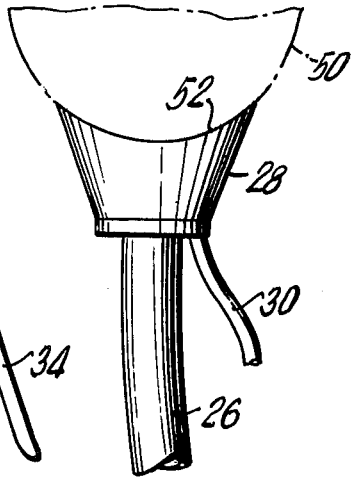
FIG. 4 is a detail view of a nozzle of the apparatus.

In the operation of apparatus 10, the rotation of blower 12 causes a stream of air to flow through tube 16 and into fan assembly 18, causing fan blades 44 to rotate. Its rotation causes the successive covering and uncovering of apertures 42 which results in a pulsating stream of air to flow in tube 20 over air heater 22, wherein heated pulsating air is delivered through hose 26 into nozzle 28 causing the aspiration of liquid from tank 32. The liquid flows through tube 30 into nozzle 28 where it mixes with the incoming heated air from hose 26 to form a liquid-air mixture or fog which impinges, with pulsating force, against surface 50 with which nozzle 28 is in contact. It is to be noted that the contacting edge 52 of the nozzle, as best seen in FIG. 4, is contoured to conform to the shape of surface 50. Edge 52 of the nozzle may have many contours to conform to the surface of the material with which it is in contact. Deep impregnation of the liquid preservative into the surface 50 of the porous material thus occurs, resulting in a longer protective period of the material.

While air blower 12 has been disclosed as electric, it is to be understood that in lieu of an electric motor to operate the fan of assembly 15, the fan may be operated by a gasoline driven engine, such as in the case when a portable air blower is desired.

What is claimed is:

1. Apparatus for applying a liquid to a surface, comprising a tank for supplying said liquid, an air blower for supplying a stream of air, a nozzle adaptable for being placed against said surface, hose means interconnecting said nozzle to said blower and said tank for aspirating said liquid from said tank during the operation of said blower, a rotary fan mounted on said air blower, an apertured plate positioned adjacent said fan, said fan and plate being positioned in the path of said air stream, whereby a pulsating liquid-air mixture is applied to said surface for impregnation thereof by said liquid during the operation of said blower.

2. Apparatus as recited in claim 1, wherein a heater is positioned in the path of flow of said air for heating thereof.

3. Apparatus as recited in claim 1, wherein said nozzle has a surface contacting portion shaped to conform to the surface to which said liquid is being applied.

4. Apparatus as recited in claim 1, wherein said apertured plate is circular and has at least two circular apertures therein positioned diametrically opposite each other.

5. Apparatus as recited in claim 1, wherein said fan has fan blades extending radially in overlapping relation with said apertured plate, said apertured plate being circular and having at least two circular apertures therein positioned diametrically opposite each other, said fan blades having ends positioned radially inwardly of the outer edges of said apertures to provide openings through which said air stream flows.

6. Apparatus for providing a pulsating stream of a mixture of a liquid preservative and air for application to the surface of a porous material for impregnation thereof, comprising an air blower for providing a stream of air, a housing for said blower, a rotary fan mounted on said housing in the path of said air stream for rotation thereby, an apertured plate positioned downstream of said fan and adjacent thereto, said plate having opposed apertures through which said air stream passes, said fan having radially extending blades overlying said apertures for successive covering and uncovering of said apertures during rotation of said fan by said air stream, a hollow tube positioned downstream of said plate for providing a passage for said air stream, a nozzle, a tank for supplying said liquid preservative, and flexible conduit means interconnecting said nozzle to said tank and said tube for aspiration of said liquid from said tank during operation of said blower and delivering a pulsating liquid-air mixture to said surface.

7. Apparatus as recited in claim 6, wherein said fan blades have ends which terminate inwardly of the outer edges of said apertures to provide openings for the continuous flow of said air stream during operation of said air blower.

8. Apparatus as recited in claim 7, wherein an electric heater is positioned in said hollow tube for heating said air stream during its flow through said tube.

9. Apparatus as recited in claim 8, wherein said nozzle has a contact surface shaped to fit the contours of the surface against which said nozzle is placed during application of said pulsating heated liquid-air mixture.

* * * * *